United States Patent [19]

Chang

[11] Patent Number: 4,765,003

[45] Date of Patent: Aug. 23, 1988

[54] PORTABLE HANDS-FREE WASH STAND

[76] Inventor: Chen-Hsiung Chang, 2nd Fl., 11, Sublane 4, Lane 95, Yu Chi Road, Yung Ho, Taipei Hsien, Taiwan

[21] Appl. No.: 81,676

[22] Filed: Aug. 5, 1987

[51] Int. Cl.[4] ..... A47K 1/02

[52] U.S. Cl. ..... 4/624; 4/626

[58] Field of Search ..... 4/624, 625, 626, 619, 4/620, 622, 628, 631; 134/57 R

[56] References Cited

U.S. PATENT DOCUMENTS

| | | | |
|---|---|---|---|
| 3,594,830 | 7/1971 | Clifton | 4/625 |
| 4,130,123 | 12/1978 | Wines, Jr. et al. | 4/626 |
| 4,336,619 | 6/1982 | Hinkel et al. | 4/619 |

*Primary Examiner*—Henry J. Recla
*Assistant Examiner*—L. J. Peters
*Attorney, Agent, or Firm*—Donald C. Casey

[57] ABSTRACT

A portable hands-free wash stand characterized by upper and lower foot pedals on its ladder-shaped bottom block for controlling water pump to pump up clean water to feed pipe for wash, and comprising a control switch for the selection of warm water and cool water, wherein waste water is collected in waste water storage tank; a low water level indicating lamp turns on when clean water of clean water storage tank been used up so as to advise people to move the present wash stand to a specific location for filling clean water and draining off waste water.

1 Claim, 5 Drawing Sheets

PORTABLE HANDS-FREE WASH STAND

BACKGROUND OF THE INVENTION

Every variety of conventional wash stands is normally set in fixed type in bathroom or at one corner of the house, which kind of arrangement shows various disadvantages as exampled hereinafter:

1. It is not convenient for use in fixed type.
2. After gotten a wash, faucet should be turned off by hand which may cause the clean hands be contaminated and would not get to the end of cleaning and sanitation.
3. In small restaurants or eateries the conventional wash stand can not be set at best convenient location for customers to wash their hands before and after meal.

The present invention provides a portable hands-free wash stand, which is characterized in that:

1. It is portable and can be pushed or pulled by hands to any desired location.
2. It has a foot pedal operation system to control water volume and heater so as to keep the washed hands free from touch and contamination.
3. It has a feed pipe control switch to control the outflow of warm water and cool water for the convenience of use.
4. Both clean water and waste water are separately collected in respective clean water storage tank and waste water storage tank to avoid any contamination.
5. When clean water is used up, the wash stand can be moved to a specific location for filling clean water and discharging waste water.

SUMMARY OF THE INVENTION

The present invention provides a portable hands-free wash stand and, more particularly, a wash stand characterized by a control switch to set for the control of cool water and warm water, which can be located at any place for washing hands by clean water and drying wet hands by heating air without the operation of hands, comprising a ladder shaped bottom block, said ladder shaped bottom block comprising a foot pedal on the left to control water pump for pumping clean water from clean water storage tank through feed pipe to the basin for wash and another foot pedal on the right to control heater for drying wet hands, wherein the waste water is collected in waste water storage tank and when clean water is used up the embodiment of the present inveniton can be moved to a proper location for filling clean water and discharging waste water.

BRIEF DESCRIPTION OF THE DRAWING

FIG. 3-1 is a fragmentary sectional view of power source of the present invention.

FIG. 3-2 is a cross-sectional view of rolling wheel of the present invention.

DETAILED DESCRIPTION OF THE PREFERRED EMBODIMENT

Figure 1:
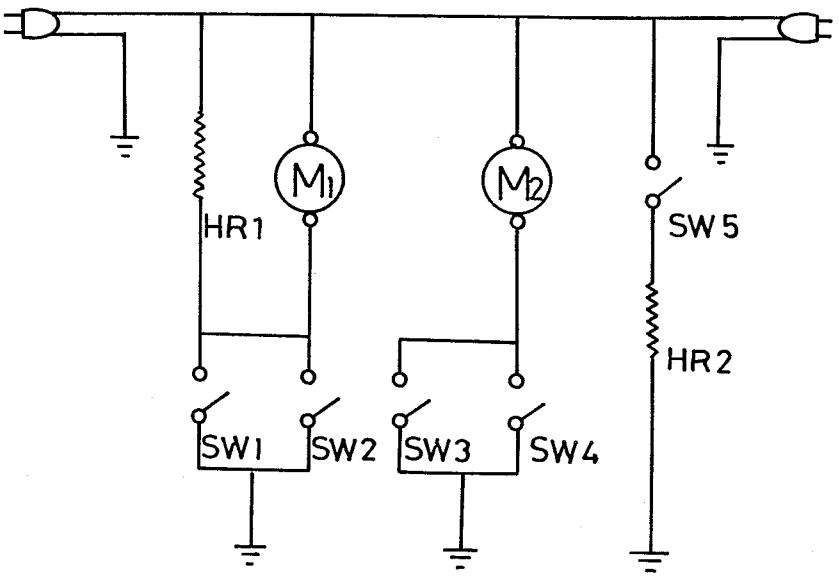
FIG. 1 is a circuit diagram for the present invention.

According to the present invention, as shown in FIG. 1, the connection of $SW_1$ and $SW_2$ is in parallel, and when $SW_1$ or $SW_2$ is on the $HR_1$ (heating wire) and ventilator ($M_1$) are turned on at the same time to blow heating air for drying wet hands. The connection of $SW_3$ and $SW_4$ is also in parallel, and when $SW_3$ or $SW_4$ is on it will make water pump ($M_2$) to start pumping clean water to feedpipe for wash. The $SW_5$ is to control $HR_2$ (heating wire) to heat pumped water be warmed up.

Figures 1, 3:
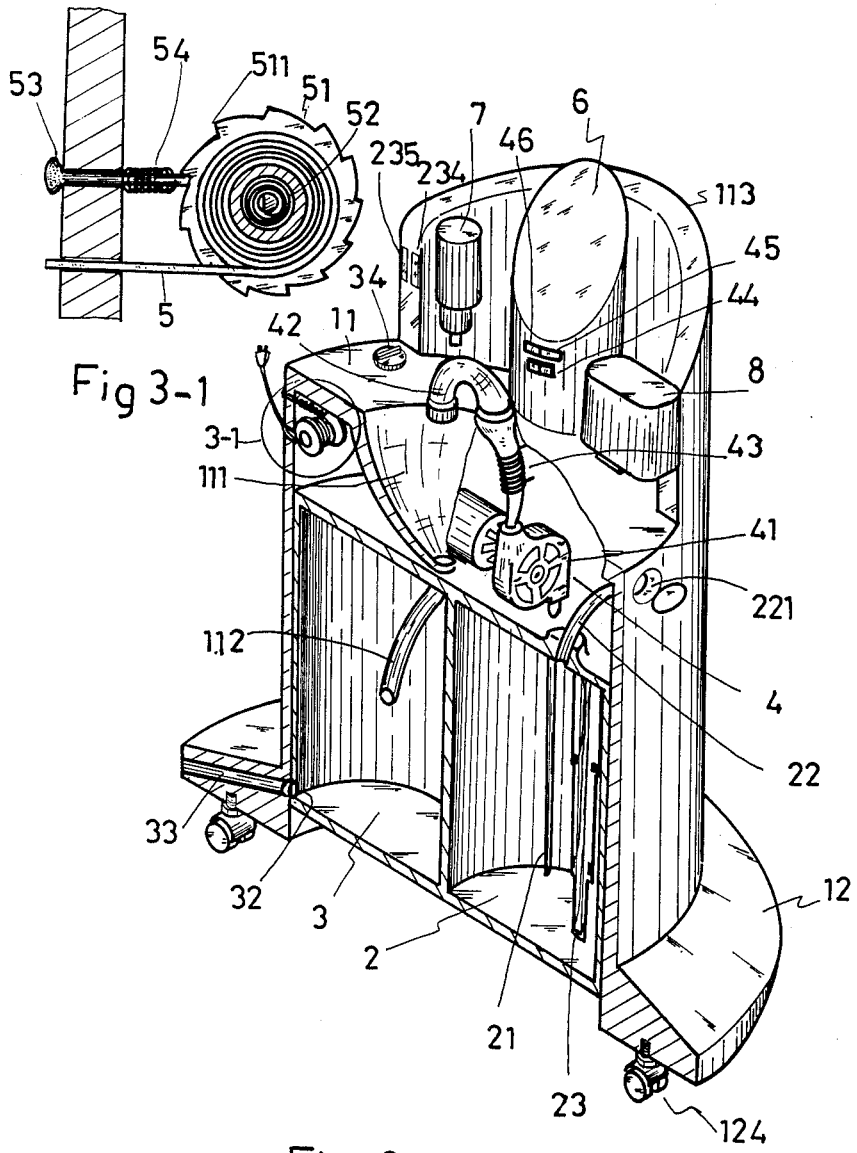
FIG. 3 is a cross-sectional view of a wash stand of the present invention.
Figures 2, 3:
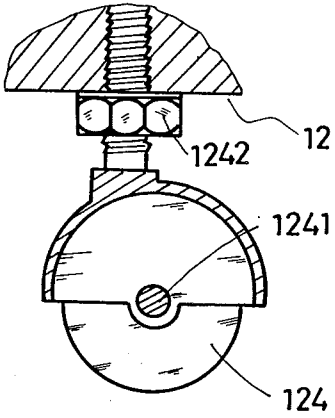

According to the present invention, as shown in FIG. 3, the body (1) of the wash stand comprises a clean water storage tank (2), a waste water storage tank (3) and a motor pump chamber (4), said motor pump chamber (4) is located on the top of the clean water storage tank (2) and waste water storage tank (3), wherein the running of water pump make the pump suction pipe (21) suck in clean water from clean water storage tank to feed pipe (42) for wash; the body (1) of the wash stand also comprises a table (11), said table is characterized by its basin (111) which has centrally a basin stopper, and an arc-shaped back stand (113) which comprises centrally a mirror holder (6), a soap can (7) on the left and a heater (8) on the right; the mirror holder (6) has on its lower part a control switch (44) and indicating lamp (46)(45) for respective control and indication of cool and warm water; the waste water on the basin (111) is drained away through water pipe (112) to waste water storage tank (3) for further drainage; the soap can (7) contains soap water for cleaning use; the water level indicating lamp (235) is to give warning of low water level so as to know the right time to move the present wash stand to a proper place for filling clean water and draining waste water.

The body (1) of the embodiment of the present invention comprises furthermore an inferior bottom block (12) in ladder shape which is characterized by its upper foot pedal (121) (121') and lower foot pedal (122) (122') in the front, and an inner water drain pipe (33) beneath the waste water storage tank (3); said foot pedals (121) (121') (122) (122') all are characterized by their respective control switches (123) (as microswitch), wherein the upper foot pedal (121) and lower foot pedal (122) control the water pump (41) of motor pump chamber (4) to pump up clean water for wash, the upper foot pedal (121') and lower foot pedal (122') control the heater (8) to blow heating air for drying wet hands; said water drain pipe (33) is characterized by its electro magnetic valve (32) which is controlled by water drain switch (34).

The clean water storage tank (2) of the embodiment of the present invention comprises a water filling pipe (22) so as to clean water fill thereinto from its water intake (221).

The water feed pipe (42) of the embodiment of the present invention is characterized by its heating wire (43) which is controlled by switch (44) to heat cool water warm up, wherein the warm water indicating lamp (45) and cool water indicating lamp (46) are fixed superiorly on the top of the switch (44).

Figure 2:
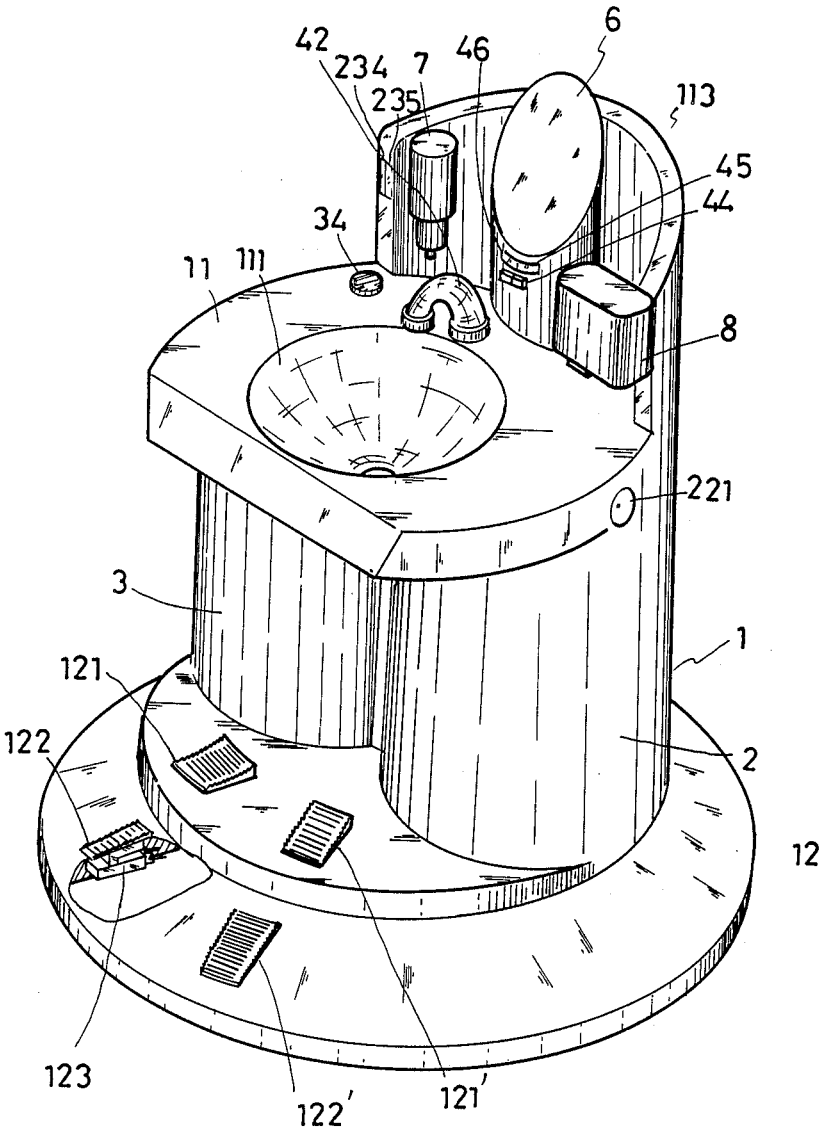
FIG. 2 is a perspective view of a wash stand embodying the present invention.
Figure 4:
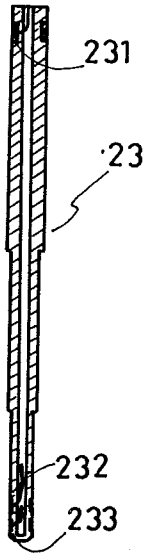
FIG. 4 is a cross-sectional view of water gauge device of the present invention.
Figure 5:
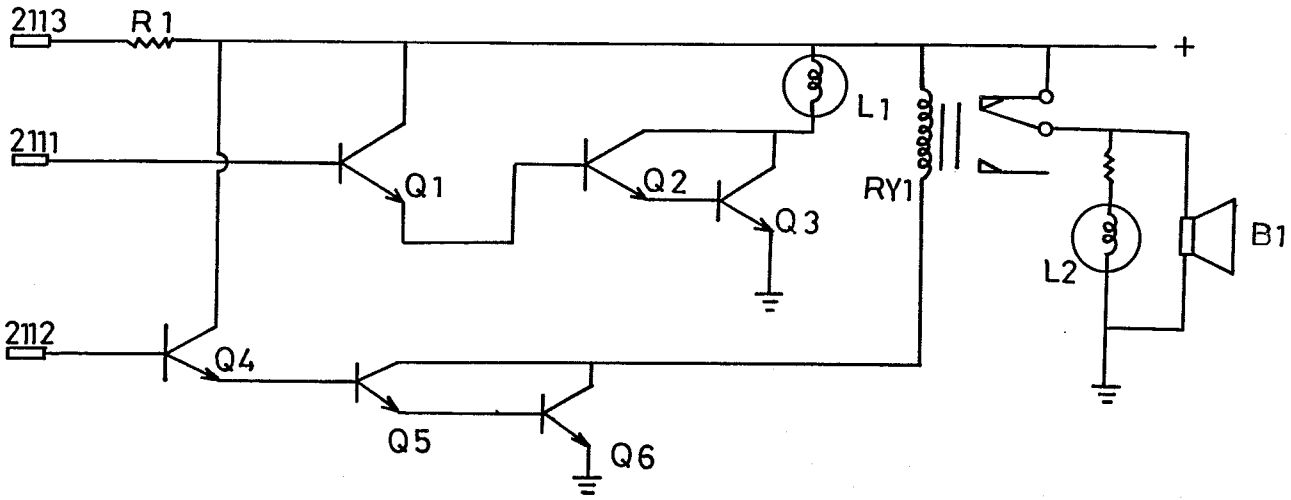
FIG. 5 is a circuit diagram for water gauge device of the present invention.

The body (1) of the embodiment of the present invention is furthermore characterized in that the big water space of respective clean water storage tank (2) and waste water storage tank (3) enables drink and food business to locate the embodiment of the present invention on the front of small restaurants or eateries for customers to wash and dry their hands so as to improve the sanitation. According to the present invention, as shown in FIG. 3-1, the electrical wire (5) is reeled in the ratchet (51), which ratchet (51) is characterized by its spring (52) and saw tooth (511) for taking up the electrical wire (5) of the ratchet (51) in such a manner that when the electrical wire (5) is drawn to a desired length it can be kept in position by means of the cottor (53) and spring (54) braking against ratchet (51) to prevent the electrical wire (5) from contraction; when to take up the electrical wire (5) just throw back the cottor (53) and the spiral spring (52) will immediately reel up the electrical wire (5) onto the ratchet (51). According to the present invention, as shown in FIG. 3-2, each rolling wheel (124) is fixed by respective axle shaft (1241) and nut (1242) onto the under bottom of the bottom block (12) so as to enable the body (1) of the present invention be portable to any desired place for any proper requirement. According to the present invention, as shown in the structure of FIG. 4 and in the circuit diagram of FIG. 5, the water gauge device (23) is an insulator, comprising one superior metal plate (231), one inferior metal plate (232) and one common metal plate (233) in between, which water gauge device works in such a manner that when the clean water of clean water storage tank (2) is in high water level $Q_1$ turns on to make $Q_2$,$Q_3$ turn on the indicating lamp (234) ($L_1$) so as to show the tank in high water level; when the water level below the level of the metal plate (232) $Q_4$ turns on to make $Q_5$,$Q_6$ turn on the relay ($RY_1$) and the buzzer $B_1$ which relay ($RY_1$) will then turn on the indicating lamp (235).

I claim:

1. A portable hand-free wash stand, characterized by hand-free operation of the water supply and the hot air drying means for washing and drying hands through the operation of foot pedal controls comprising:

a housing having a side wall, bottom pedestal and top, said housing having a chamber therein that is divided into a supply water storage tank having top, sides and bottom walls, and a waste water collection tank having top, sides and bottom walls, said supply tank having a water inlet filling port and a water egress emptying port, said supply tank having a water outlet conduit that enters the tank through the water egress emptying port for supplying water from inside the supply tank to outside said tank for use of washing ones hands, said water exhaust conduit connected to a water pump to pump up supply water from the storage tank, said pump connected to a feed pipe that extends substantially vertically upwards and perpendicular to the housing top, and also defining a spout extending downwardly therefrom to supply water from the supply tank for the purpose of washing one's hands; heating means for heating said water from said supply tank through said feed pipe, warm and cool water control switch means for controlling said heating means to vary the temperature of the supply water through the feed pipe, said supply tank having mounted therein water gauge means for indicating predetermined high and low water levels inside the tank, said housing sidewall having a side port adjacent the inlet filling port of said supply tank and connected thereto for allowing water to be supplied to the supply tank from the outside, said housing top defining a basin, the bottom of which terminates in an outlet, said waste water tank having an inlet port connected to said basin and an outlet waste water egress drain port in the side of the tank near the bottom to allow any water in the collection tank to drain out, said spout being directed into said basin, an electromagnetic valve mounted in said drain port for opening and closing said drain port, a drying, hot air heater for dyring one's hands mounted on the top of the housing, said pedestal having a stepped cross-section to enable a child to step up to more conveniently reach the spout of the feed pipe, said pedestal having rolling wheels fixed onto the underside thereof for mobility, and said pedestal having two pairs of foot pedals, an upper pair of pedals mounted on an upper step of said pedestal and a lower pair of foot pedals mounted on a lower step of said pedestal, means connected between one pedal of each pair to operate said pump, and between the other pedal of each pair to operate the hot air heater, a mirror having a mirror housing mounted on said housing, said warm and cool water control switch means being mounted on said mirror housing including indicating lamps for indicating whether the water heating means is on or off.

* * * * *